United States Patent [19]

Rahmfeld et al.

[11] Patent Number: 4,476,915

[45] Date of Patent: Oct. 16, 1984

[54] METHOD FOR REGULATING INDIVIDUAL DRIVES OF AN ARCUATELY SHAPED MULTI-ROLLER CONTINUOUS STRAND CASTING MACHINE FOR METAL, PARTICULARLY STEEL

[76] Inventors: Werner Rahmfeld, Stockweg 32, D-4330 Mülheim; Achim Kubon, Am Lerchenfeld 6, D-4133 Neukirchen-Vluyn; Dieter Stalleicken, Bremweg 56, D-4100 Duisburg 46, all of Fed. Rep. of Germany

[21] Appl. No.: 246,056

[22] Filed: Mar. 20, 1981

[30] Foreign Application Priority Data

Mar. 22, 1980 [DE] Fed. Rep. of Germany ..... 3011137

[51] Int. Cl.[3] ..... B22D 11/16

[52] U.S. Cl. ..... 164/484; 164/454; 164/413

[58] Field of Search ..... 164/442, 448, 454, 484, 164/413

[56] References Cited

U.S. PATENT DOCUMENTS 3,752,210 8/1973 Gallucci et al. ..... 164/442

3,861,456 1/1975 Gallucci et al. ..... 164/442

*Primary Examiner*—Kuang Y. Lin

*Attorney, Agent, or Firm*—Mandeville & Schweitzer

[57] ABSTRACT

A method for continuous casting of metallic strands which provides a maximum compressive stress to the strand at the precise bending point of the strand guide. In this manner, continuous casting speeds of greater than 0.8 m/min. can be utilized without the otherwise present potential for ruptures and tears. Pairs of supporting rollers are spaced along the strand guide. A bending point is defined as the precise point where the arcuate section of the strand guide becomes the linear section of the strand guide. It is at that bending point that the compressive forces on the cast metallic strand are maximized by the selected driving of the supporting rollers, located downstream of the bending point. The number of supporting rollers located upstream of the bending point is not less than twice the number of supporting rollers located downstream of the bending point.

4 Claims, 2 Drawing Figures

METHOD FOR REGULATING INDIVIDUAL DRIVES OF AN ARCUATELY SHAPED MULTI-ROLLER CONTINUOUS STRAND CASTING MACHINE FOR METAL, PARTICULARLY STEEL

BACKGROUND OF THE INVENTION

The present invention is directed towards a method and a particularly advantageous drive arrangement for regulating the individual drives of an arcuately shaped multi-roller continuous strand casting machine for metal, particularly steel, in which at least some of the drives powered by motor or by generator are regulated torque-dependently on the others, which creates compressive forces to the direction of the cast strand in the cross section of the strand.

A regulating method of this type is used in strand casting for the purpose of "compression casting". "Compression casting" refers to the compressive forces created in the direction of motion of the cast strand in the strand cross section. The coordination of the driving forces is to prevent an excessive tensional stress and/or bending stress during the cooling stages of the casting metal by creating, in each instance, counter-directed forces to the direction of travel the strand by means of the rolls which convey the casting strand.

It is necessary to create compressive forces in the strand cross section to the direction of motion of the casting strand by means of the conveyor means of the arcuately shaped multi-roller continuous strand casting machine in order to minimize the maximal stresses occurring in the area of the bending point. These compressive forces are absorbed, as negative tensional components, by the total tension, thereby relieving the tensionally stressed strand shell. The entire deformation of the strand shell is to be compared with the critical expansion value of the work material employed in order to reveal what the stress permissible is on the casting material during its cooling stage. The tension as well as the expansion of the strand shell constitute criteria in calculating the total stress. Also, the plastic and elastic behavior of the strand shell is to be taken into consideration in the given high temperatures.

It is difficult to calculate the stress on the strand shell because it is time dependent. The calculations may be based, within the alignment area, on interior deformation because of bulging; on tensile forces because of alignment; and on interior deformation because of roller striking and because of an uneven alignment of the roller track, as well as on the interior deformation by surface pressure of the rollers (hertz's pressure). The enumerated causes of stress may not simply be added together because of individually time-dependent factors.

From observations and re-calculations, and from the behavior of the steels in laboratory tests it is possible to estimate the progress of the strand-shell expansion in the area of solid/liquid interface, depending on time and temperature.

The factors thereby determined lead to the recognition that expansion factors above the predetermined limit cause increased damage in the work-material structure. Large shifts of the forming and solidifying crystals cause intercrystaline cracks which, because of further heavy stress, cannot close homogenously anymore so that liquid casting metal will fill the crack, thereby causing the subsequent crystalization to occur under changed chemical and physical conditions. The crack material, therefore, displays other properties than the work material surrounding it. The interior cracks cause some weak spots in the work material, which are to be classified according to product use, so that, in the end, types of material must be sorted out according to their intended requirements.

DESCRIPTION OF THE PRIOR ART

As to the application of "compression casting", DE-AS No. 22 41 032-IPC B 22 D 11/128, teaches the regulation of some of the drives torque-dependent on the other drives. To this end, drives, interconnecting in the direction of the moving strands, for the rollers which convey the strand are switched in a manner that the rear set of rollers presses the strand into the set of rollers following in the direction that the strand moves. It has, however, been shown that the torque difference between the interconnecting rollers does not suffice to create a compressive force of that type within the strand shell, enabling said force to equalize the stresses of the casting strand in the alignment area.

SUMMARY OF THE INVENTION

The objective of the present invention is to build, under consideration of the tensile forces occuring in the strand cross-section, more advantageous, particularly greater, counter forces for reducing the tensile forces while conveying the casting strand.

This objective is achieved, according to the present invention in that for casting speeds of greater than 0.8 m/min and subsequent to separating the starting strand from the cast strand, at least those drives in front of the alignment area in the arcuate section of the strand guide are powered by motor, and a plurality of drives, at least beginning at the linear element of the area of alignment, are powered by generator in the direction of motion. According to the present invention, sufficiently large compressive forces cannot be created on the basis of lower casting speeds. Another recognition of the invention is the additional requirement of charging the cast strand with compressive forces only subsequent to the conclusion of the conveying process. The most important recognition of the present invention is the fact of working in the bending point with compressive force charges so that the stress on the strand, decreased by the tensile tension, affects only the cast strand. The stress on the strand, decreased in that manner, is, however, lower than the critical deformation factor of the work material and, therefore, no further cracks occur in the surface. Furthermore, cracks are avoided in the solidifying nuclear zone at the interface solid/liquid. The invention is particularly advantageous in relation to crack-sensitive types of steel which may now be cast without cracks developing.

According to the invention, all the drives in the arcuate section, including the bending point of the strand guide, are powered by motor, and the drives within the linear section of the alignment area are powered by generator. The basic idea of the invention is that it is always advantageous that the sections of the cast strand in front of the drives powered by motor are pulled, and the successive sections of the cast strand are pushed, in which procedure the drives powered by generator act as a brake to the pushed drives which are powered by motor.

A further aspect of the method, according to the present invention, is that all the drives in the arcuate section of the alignment area in the strand guide are powered by motor, and a plurality of drives in the area of alignment are powered by generator. In this instance, the brake element consists of drives of the entire area of alignment.

Furthermore, according to the invention, the compressive pressure for casting metallic strands in the alignment area, resulting in the direction of motion, is adjusted to at least 30 Mp, and may be adjusted upwardly as the cast strands grow wider. The method, according to the invention, may be improved yet further by adjusting the compressive force, resulting in the direction of motion, upwardly as the casting speed increases.

A particular characteristic of the invention, furthermore, resides in the fact that the resulting compressive force may be adjusted to a maximum in the alignment area.

The drive arrangement for the application of the method, according to the invention, is, furthermore, such that the ratio of the drives powered by motor to the drives powered by generator is, in their number, approximately 2:1 or greater than 2:1. While previously weight and friction of the cast strand, in the strand guide, consumed the compressive forces resulting from the torque differences, it was established by way of intensive testing that the ratio of the drives powered by motor to the drives powered by generator, create a usable effect only subsequent to reaching a certain value.

A desired ratio between the driving and braking drives may, specifically, be established if the number of drives residing in the arcuate section of the arcuately shaped multi-roller continuous strand casting machine, is at least twice that of the number of drives in the linear, horizontal area, i.e., follows the non-balanced equation $n_{arc}=2n_{line}$, in which "n" represents the number of drives and "arc" represents the length of the strand guide between continuous casting iron-cast mold and bending point; and "line" represents the length of the area from the bending point in the direction of motion.

An exemplary embodiment of the operational arrangement, according to the present invention, is represented in the drawing, with the aid of which the method, according to the invention, is described as follows:

DETAILED DESCRIPTION OF THE INVENTION

Figure 1:
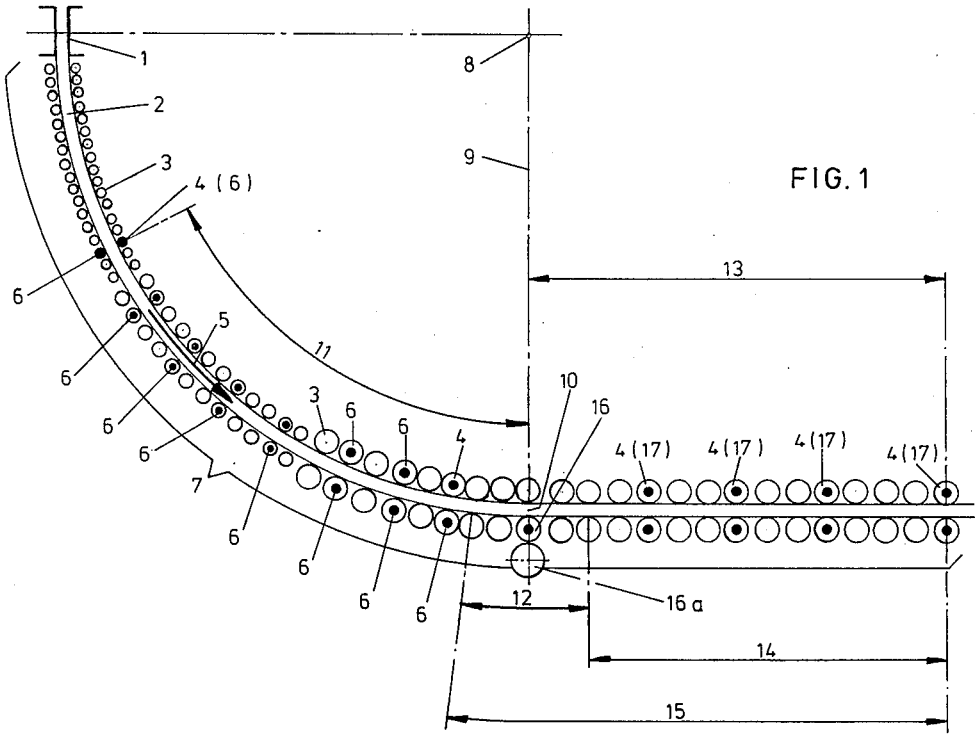
FIG. 1 represents the roller arrangement in a strand guide for an arcuately shaped multi-roller continuous strand casting machine.

The cast strand 2 (FIG. 1) originates in the continuous casting cast-iron mold 1, said strand carried by means of a number of non-powered supporting rollers 3 and by supporting rollers 4 (powered by electro-motors, not illustrated), being continuously conveyed in the direction of the motion of the strand 5. The drives of the powered supporting rollers 3 are represented by blackened centers and are numbered 6. The entirety of the supporting rollers 3 form the strand guide 7. This strand guide 7 extends arcuately, i.e., in the exemplary embodiment illustrated, around the center of curvature 8, with the horizontally measured distance of the continuous casting cast-iron mold 1 from the center of curvature 8 as radius. The application of the invention extends to all types of "bent" strand guides 7.

The vertical line 9, from the center of curvature 8, represents, in the center of the strand thickness, the bending point 10 in which the casting strand 2 cools and solidifies and is again bent back into the horizontal plane, i.e., it is straightened. The following distinctions are made: the arcuate section 11 upstream of bending point 10, the alignment area 12, the area 13 downstream of the bending point which forms the "line", and the linear element 14 adjacent to and downstream of the alignment area 12. Alignment area 12 and linear section 14 form area of alignment 15. Eight pairs of supporting rollers, with drives 6 which are powered by motor, are arranged within the arcuate section 11, possibly with the exception of the supporting roller 16, which, with bearing roller 16*a*, is under the bending point 10. The supporting rollers 4 in the linear section 14 have drives 17 powered by generators. The drives 6, consequently, create a tensile force and the drives 17 create a braking force counter to the tensile force, which, in each instance, are transferred to the casting strand 2 by means of the supporting rollers 4. Seen overall, compressive forces are originally formed in the casting strand 2, said forces causing a local compression of the strand shell in direction of motion 5, in which the entire deformation of the strand shell at the solid/liquid phase interface in the cast work material is decreased. The entire deformation of the strand shell represents a resulting deformation which arises because of tensile or, if applicable, compressive forces (in direction of motion 5), because of bulging, because of aligning, because of heat-induced roller striking, and because of alignment flaws as well as because of surface pressure at the solid/liquid phase interface. A coordination of the deformation components causes a maximum in the alignment area 12. The decrease of this entire deformation, according to the invention, minimizes the risk of interior cracks developing in the casting strand 2 during the cooling process.

Figure 2:
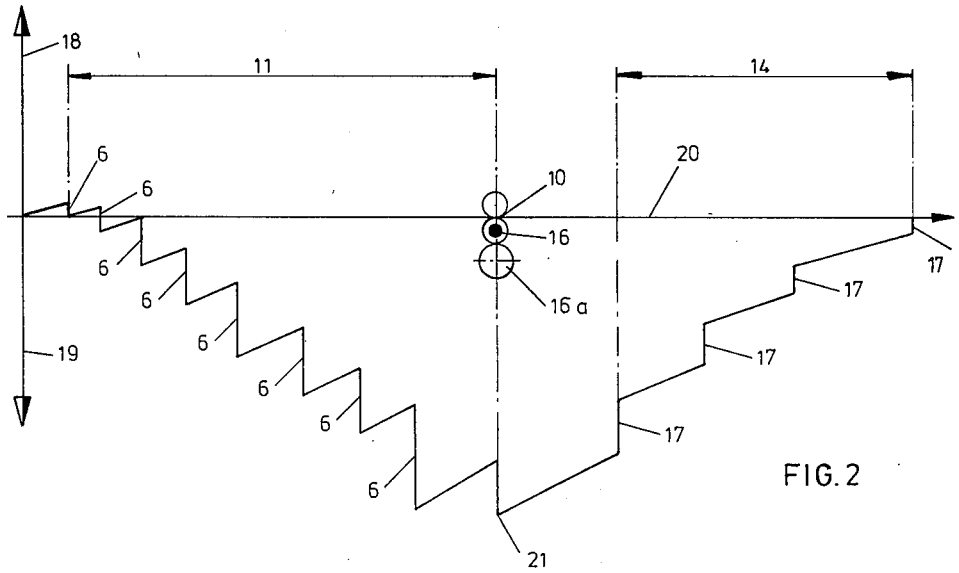
FIG. 2 represents a graph of a power track of the power created in the strand cross section in applying the method according to the present invention.

FIG. 2 illustrates the progress of the created forces by the drives 6 powered by motor or, if applicable, drives 17 powered by generators. The ordinate represents tensile forces 18 or, if applicable, compressive forces 19, and the abscissa represents the course of the strand 20. Only weak tensile forces affect the casting strand 2 in the area between the continuous casting cast-iron mold 1 and the beginning of the arcuate section 11. Consequently, the drives 6 powered by motor create, in stages and in the intervals of their interconnection counter to the brake effect of the drives 17 powered by generator, a maximum of the resulting compressive force at the point 21 above the bending point 10. As is also clearly shown in FIG. 2, the eight drives 6 powered by motor are faced by four drives 17 powered by generator the level of height of which are, in each instance, recognizable. (The drives 6 or, if applicable, 17 are, in each instance, provided for top and bottom rollers.) According to FIG. 2, the ratio of the drives 6 powered by motor to the drives 17 powered by generator is consequently, in the exemplary embodiment, precisely 2:1. The present invention renders it possible, according to the total number of drives (total number of drives = number of motor-powered + number of drives powered by generator), to obtain a yet finer staggering or, if applicable, displacement of the point 21 of the maximum of the compressive forces to the left or the right within the alignment area 12. It is left to the expert to choose, according to the casting work material to be cast and its cooling properties, a corresponding graph of a power track according to FIG. 2.

We claim:

1. A method for continuous metallic casting comprising the steps of:

(a) separating a starter strand from a cast metallic strand;

(b) continuous casting a metal strand at a speed greater than 0.8 m/min;

(c) passing said cast metallic strand through a strand guide, said strand guide having an upstream arcuate section and a downstream linear section separated thereby by a bending point, both of said sections having pairs of supporting rollers;

(d) driving the pairs of supporting rollers in said arcuate section;

(e) producing compressive forces to act upon said cast metallic strand by using the torque of the pairs of supporting rollers in said linear section to brake the forces created by said driving pairs of supporting rollers in said arcuate section;

(f) said compressive forces reaching a maximum at said bending point; and (g) the number of pairs of driving rollers in said arcuate section being at least twice the number of pairs of driving rollers in said linear section.

2. A method as claimed in claim 1, wherein:

(a) said driving of said pairs of supporting rollers in said arcuate section is done by motors; and (b) said driving of said pairs of supporting rollers in said linear section is done by generators.

3. A method as claimed in claim 1, further including (a) increasing the relative compressive forces produced in step (e) for increases in the width of said cast metallic strand.

4. A method as claimed in claim 1, further including:

(a) increasing the relative compressive forces produced in step (e) as the casting speed increases.

* * * * *